US005330285A

United States Patent [19]

Greves et al.

[11] Patent Number: 5,330,285

[45] Date of Patent: Jul. 19, 1994

[54] APPARATUS FOR DEFLATING TIRES OF MOVING VEHICLES

[75] Inventors: Kenneth J. Greves; Daniel R. Olive, both of Lawrenceburg, Ind.

[73] Assignee: Stop-Stick, Inc., Lawrenceburg, Ind.

[21] Appl. No.: 10,662

[22] Filed: Jan. 28, 1993

[51] Int. Cl.[5] ..... E01F 13/00

[52] U.S. Cl. ..... 404/6; 256/1

[58] Field of Search ..... 404/6, 9; 256/1, 13.1

[56] References Cited

U.S. PATENT DOCUMENTS

| | | | |
|---|---|---|---|
| 1,094,226 | 4/1914 | Le Duc . | |
| 1,232,575 | 7/1917 | Lefort . | |
| 1,276,100 | 8/1918 | Niznik | 256/1 |
| 1,721,978 | 7/1929 | Sherwood . | |
| 2,313,388 | 3/1943 | McDonald . | |
| 2,325,260 | 7/1943 | May . | |
| 2,346,713 | 4/1944 | Walker . | |
| 2,912,229 | 11/1959 | Persgard . | |
| 3,652,059 | 3/1972 | Groblebe | 256/1 |
| 4,096,782 | 6/1978 | Deschenes . | |
| 4,382,714 | 5/1983 | Hutchinson | 404/6 |
| 4,473,948 | 10/1984 | Chadwick . | |
| 4,544,303 | 10/1985 | Glasmire | 404/6 |
| 4,995,756 | 2/1991 | Kilgrow et al. | 404/6 |

OTHER PUBLICATIONS

Hovey Industries, Ltd. Canada, various pages, Nov. 24, 1992.

Sherwood International Export Corporation, Northridge, Calif., instruction sheet.

Stinger Spike Systems, Inc., Monticello, Utah, various pages of brochure.

*Primary Examiner*—William P. Neuder

*Attorney, Agent, or Firm*—Frost & Jacobs

[57] ABSTRACT

A tire-puncturing apparatus is disclosed which can be placed on a road surface in front of a moving vehicle such as an automobile. The apparatus has a collapsible outer cover which makes it safe to handle the apparatus before its use, yet being collapsible, does not impede the operation of the apparatus in puncturing the tires of the target moving vehicle. A special three-piece spike is used to first penetrate the tire's surface and then embed a hollow quill in the tread of the tire such that the tire will deflate at a controlled rate, rather than causing a blowout and subsequent loss of control of the vehicle. The tire-puncturing apparatus is designed to be easily carried in the trunk of a police vehicle, and has an optional mating connector such that two or more of the tire-puncturing devices can be rigidly connected together to cover a larger portion of the road surface.

15 Claims, 5 Drawing Sheets

APPARATUS FOR DEFLATING TIRES OF MOVING VEHICLES

TECHNICAL FIELD

The present invention relates generally to police safety equipment and is particularly directed to an easily deployable device which can be used to slow down and stop speeding cars that are driven by persons avoiding detainment by police officers. The invention will be specifically disclosed as a tire-puncturing apparatus that can be easily placed across a road surface in the path of a car which is to be apprehended, and which has an easily deformable outer housing that allows police officers to safely handle the apparatus before its use.

BACKGROUND OF THE INVENTION

Various devices for stopping the movement of vehicles are known in the prior art. Such prior art includes heavy-duty barriers for stopping military vehicles, such as tanks and half-tracks, and other prior art devices which have been designed specifically for stopping automobiles.

Generally speaking, devices for stopping automobiles have taken the form of some type of implement that is placed upon the ground, wherein the implement contains a series of nails or sharp spikes for puncturing the tires. Such devices are disclosed in patents such as Le Duc (U.S. Pat. No. 1,094,226), Sherwood (U.S. Pat. No. 1,721,978), Persgard (U.S. Pat. No. 2,912,229) and Deschenes (U.S. Pat. No. 4,096,782). A somewhat different tire-puncturing device is enclosed in Chadwick (U.S. Pat. No. 4,473,948), which discloses a number of sharp drive pins mounted on a base plate that is placed by hand against a vehicle's tire, to prevent a non-moving vehicle from being driven away from a given location.

Some rather recent automobile-stopping devices include a "Road Spike System", manufactured by Sherwood International Export Corporation located in Northridge, Calif., which consists of a base strip that lays upon a road surface, and contains a series of vertical spikes for puncturing passing tires. Another tire deflating device uses a series of angular rocking arms which position nails or spikes in a near-vertical direction for puncturing a passing tire, and which is manufactured by Stinger Spike Systems, Inc., of Monticello, Utah. A third tire deflating device consists of two rows of hollow spikes inserted in a four-ply rubber belting which has a segmented metal backing, and is manufactured by Hovey Industries Ltd. of Gloucester, Ontario, Canada.

The implements of the prior art involve sharp spikes or nails which can cause injury to a user if not handled properly. The products made by Road Spike System, Stinger Spike System, and Hovey all come in custom-built metal suitcases, to protect the user from the exposed spikes, and therefore, are not particularly mobile. The tire deflating implements disclosed in Le Duc, Sherwood, Persgard, Deschenes, and Chadwick would also have a similar problem, in that the implements must be handled by the user very carefully, and also must be stored in some safe manner. Each of the prior art implements would require some type of special carrying or storage container, since it is obvious that the implements could not be simply stored in the trunk of a car that is full of other equipment. Since such implements with storage containers are rather bulky, and can be quite expensive, only a select number of police vehicles would likely carry the devices. Therefore, when a need arises to stop a fleeing automobile, only certain police vehicles will have the necessary implements to answer that need.

In addition to the above shortcomings, many of the prior art implements are designed to rest upon a road surface in a particular orientation which can be disturbed during deployment of the implement. If the implement tips over during deployment, then it becomes virtually useless. The Road Spike System, discussed above, is particularly difficult to deploy since it must be unfolded while remaining in an upright orientation.

SUMMARY OF THE INVENTION

Accordingly, it is a primary object of the present invention to provide a device for puncturing the tires of a moving automobile which is safe to handle before its initial use, and is simple to place upon a road surface, such that it can be easily positioned and will not move its location once placed.

Another object of the present invention is to provide a tire-puncturing device which is small enough to easily be handled by a single person, and which, however, can be connected to adjacent similar tire-puncturing devices to cover a much larger strip of road surface.

A further object of the present invention is to provide a tire-puncturing device which uses spikes that assure a puncture, and subsequent loss of air pressure once a vehicle's tire has passed over the device.

Additional objects, advantages and other novel features of the invention will be set forth in part in the description that follows and in part will become apparent to those skilled in the art upon examination of the following or may be learned with the practice of the invention.

To achieve the foregoing and other objects, and in accordance with one aspect of the present invention, an improved tire-puncturing apparatus is disclosed which contains a series of spikes that are spaced at sufficient intervals to guarantee several punctures in a given tire that passes over the apparatus, and which has a deformable covering surface which allows for the safe handling of the apparatus before and during its deployment, yet is easily crushed by the weight of an automobile's tire as it passes over the apparatus. The apparatus is symmetrical such that, regardless of how it is placed upon the road surface, there will be a sufficient quantity of tire-puncturing spikes that are positioned in the proper orientation for puncturing a tire that is passing over the apparatus. In addition, a single apparatus made to the recommended length can be equipped with special end pieces which allow it to be rigidly affixed to similar adjacent tire-puncturing devices, thereby increasing the overall length of the tire-puncturing roadblock. In addition, each spike is designed as a three-piece unit, which assures that the tire is both punctured and will lose air pressure once the puncture has occurred, as will be described hereinafter.

In one embodiment, the spikes are held in place by a core made of styrofoam such that each adjacent spike is at an angle 60 degrees from one another, and is spaced approximately one-half inch from one another. A wire space-frame runs the entire length of the apparatus along its longitudinal axis, and is held together by some type of reinforced adhesive tape, such as strapping tape, which is wrapped around the space-frame and styrofoam core. This subassembly is placed inside an outer cover which will easily deform when a tire rolls over the assembly, and which is strong enough to support the weight of the space-frame/styrofoam core subassembly so as to protect the user who is handling the assembly.

In a second embodiment, plastic clips are used to hold each of the three-piece spikes in place. Each plastic clip is L-shaped, having a 60 degree angle between the legs of the L's. A spike is held in place along the open end of the L-shaped clip, and each adjacent clip is turned 60 degrees, such that its spike is held in place at an angle 60 degrees from the first spike's orientation. Each plastic clip is approximately one-half inch in width, so that when several of the clips are stacked up next to one another, the spikes retained by the clips are located about one-half inch from each other. In this second embodiment, the plastic clips nest together thereby forming a continuous assembly, thereby eliminating the need for a space-frame. This built-up subassembly is then inserted inside a deformable outer cover, as in the first embodiment described above.

Still other objects of the present invention will become apparent to those skilled in this art from the following description and drawings wherein there is described and shown a preferred embodiment of this invention in one of the best modes contemplated for carrying out the invention. As will be realized, the invention is capable of other different embodiments, and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification illustrate several aspects of the present invention, and together with the description and claims serve to explain the principles of the invention. In the drawings:

DETAILED DESCRIPTION OF THE INVENTION

Reference will now be made in detail to the present preferred embodiment of the invention, an example of which is illustrated in the accompanying drawings, wherein like numerals indicate the same elements throughout the views.

Figure 1:
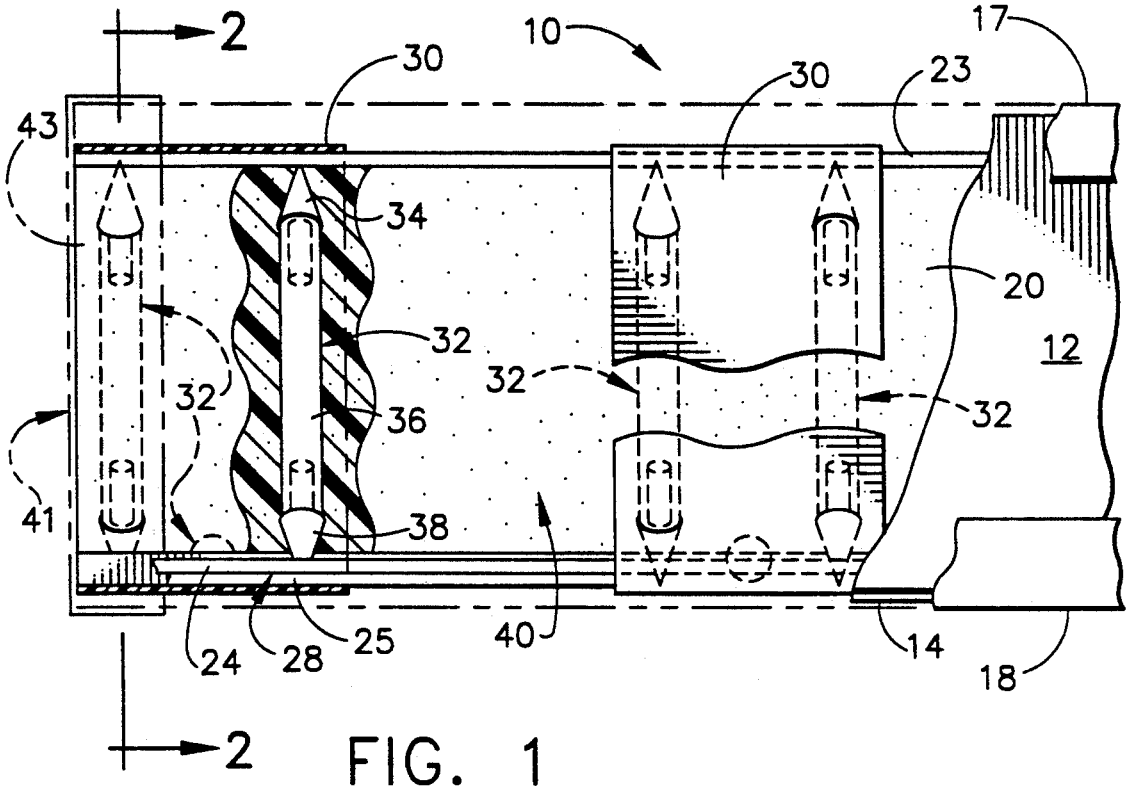
FIG. 1 is a fragmentary partially cut-away elevational view of a first embodiment of a tire-puncturing apparatus.

Referring now to the drawings, FIG. 1 shows a first embodiment of the invention in a partially cut-away view so that the details of the positioning of the spikes are easily discerned. The tire-puncturing apparatus, generally designated by the numeral 10, preferably has an overall triangular cross-sectional shape, and is approximately three feet long. The three foot length is adequate to cover a significant portion of a road surface, and will also easily fit inside the trunk space of a standard police vehicle. Three such devices could easily be attached to the inside roof of the trunk of a police vehicle for storage, and could be placed across a road surface so as to cover a majority of a particular lane.

The triangular shape is symmetrical, both in its outer dimensions, and its inner components, wherein a three-piece spike subassembly 32 (described in detail hereinafter) is positioned parallel to each of the panels 12, 14, and 16 which make up the outer surface of the tire-puncturing apparatus 10 (see FIGS. 2 and 3). Since the entire device is symmetrical, it can be placed upon a road surface in any of the six possible orientations (i.e., on any one of its panels 12, 14, or 16, and in either direction) and will be equally effective in puncturing the tires of a vehicle passing thereover from either direction. In the illustrated embodiment depicted in FIGS. 1, 2 and 3, the collapsible outer covering comprises three separate panels of laminated paper board. The first panel, generally designated by the numeral 12, is positioned at an angle 60° from the second panel (designated by the numeral 14), which in turn is positioned 60° from the third panel (designated by the numeral 16). Each of these panels consists of laminated paper board, in which an outer layer of laminating film protects the inner paper board layer from the weather. The lamination preferably comprises 1½ mil thick polypropylene laminating film. An alternative material for panels 12, 14, and 16 is an extruded polymer such as Butyrate plastic, which could be directly molded into a hollow triangular shape. Panel 12 is held in place with respect to panel 14 by a strip of adhesive tape 18. Panel 14 is positioned with panel 16 and held in place by adhesive tape 19. Panel 16 is positioned and held in place with respect to panel 12 by a strip of adhesive tape 17. These strips of adhesive tape 17, 18, and 19 each run parallel to the longitudinal axis of the tire-puncturing apparatus 10, and run the entire length of the apparatus. In this way, a weather seal is formed by the combination of the adhesive tape strips and the laminated film of each of the panels 12, 14, and 16.

An alternate form of construction is to use a four-sided box which can be folded to make the triangular shape of the tire-puncturing apparatus 10. Three of the sides of the four-sided box would be equivalent to the panels 12, 14 and 16. The fourth side of the four-sided box would constitute a small flap which would be folded along the inside of one of the panels and glued thereto creating the triangular shape. This method of forming a triangularly-shaped box is well known in the art.

A styrofoam core 20 is placed inside the collapsible outer cover (panels 12, 14, and 16), and is used in the first illustrated embodiment to hold the three-piece spike subassemblies 32 in their propcr orientation. As can best be viewed in FIG. 1, each of the spike supassemblies 32 is positioned apart from one another by a distance which is preferably one-half (½") inch. As FIG. 1 depicts, the spike subassemblies 32 are preferably in groups of three, one spike subassembly 32 pointing in each of the three possible directions of each group. Each of these groups of three is preferably separated along the styrofoam core 20 by a distance of approximately one and one-half (1½") inches. In this manner, sufficient spike subassemblies 32 are available to puncture a tire crossing the apparatus 10 without having to place spike subassemblies at each of the one-half inch intervals, thereby saving the cost of such additional spikes subassemblies.

A series of wires is run along the length of tire-puncturing apparatus 10 in the positions indicated by the numerals 22, 23, 24, 25, 26 and 27. Each of these wires runs the entire length of the tire-puncturing apparatus 10 and is parallel to its longitudinal axis. The wires preferably are made of 14 gauge pre-galvanized carbon steel, and collectively comprise a space-frame subassembly 28. Space-frame subassembly 28 is designed to give the tire-puncturing apparatus 10 enough mechanical rigidity such that the spike subassemblies 32 are not easily pushed through the bottom portion of tire-puncturing apparatus 10 at the moment a vehicle's tire crosses over the apparatus 10. There must be enough mechanical resistance to ensure that the bottom portion of the spike subassembly 32 is held in place long enough for its top portion to penetrate the tire. This will be discussed in further detail below.

The individual wires 22, 23, 24, 25, 26, and 27 of space-frame subassembly 28 are held in place by strips of reinforced adhesive tape 30. The wires are held in place in pairs, whereby the tape holds wires 23 and 24 in place as a pair, wires 25 and 27 as a pair, and wires 22 and 26 as a pair. Adhesive tape 30 is preferably two inch wide strapping tape, which is wide enough to cover the entire area of one of the groups of three spike subassemblies 32. The strapping tape helps to give mechanical strength to the overall apparatus 10. Additional adhesive tape 30 is applied to hold the space-frame subassembly 28 together around styrofoam core 20, and the entire inner workings of tire-puncturing apparatus 10 become an interior core subassembly 40. Interior core subassembly 40 can be inserted as an entire unit into the interior spaces of the collapsible outer cover, which comprise panels 12, 14, and 16. If desirable, the entire interior core subassembly 40 can also be removed from the inside of the collapsible outer panels without detracting from the integrity of the outer panels after they have been assembled.

Figure 2:
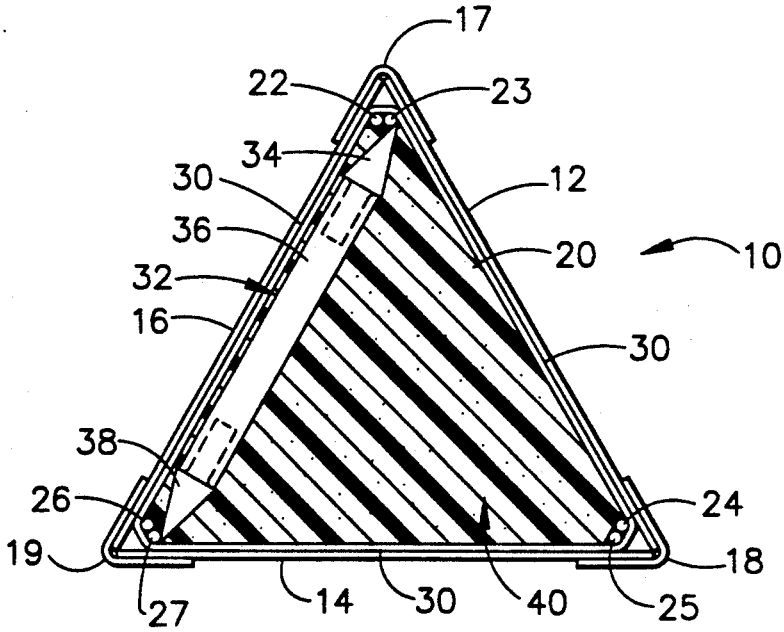
FIG. 2 is a section view of the tire-puncturing apparatus of FIG. 1, taken along the section line 2—2 thereof.
Figure 3:
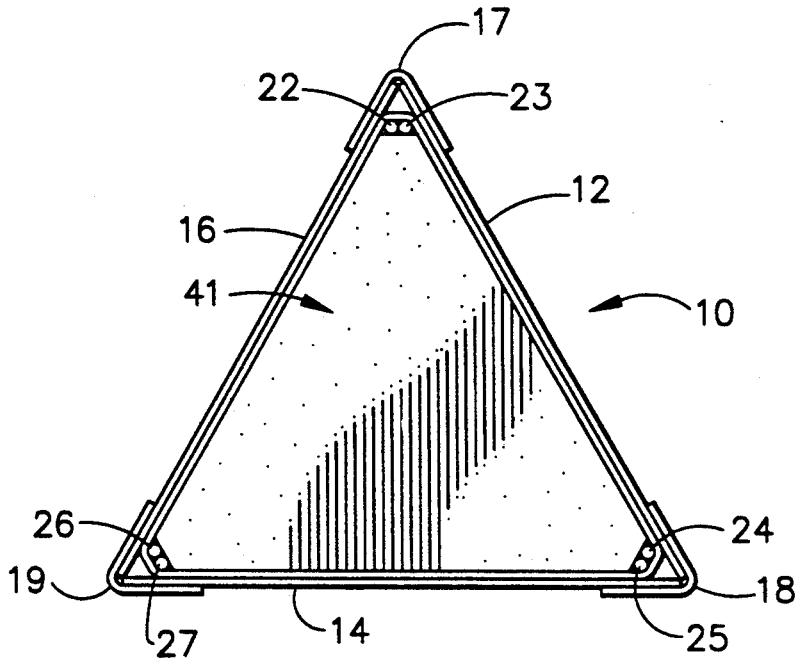
FIG. 3 is a side elevational view of the tire-puncturing apparatus of FIG. 1, taken from the left end of the apparatus as viewed in FIG. 1.
Figure 9:
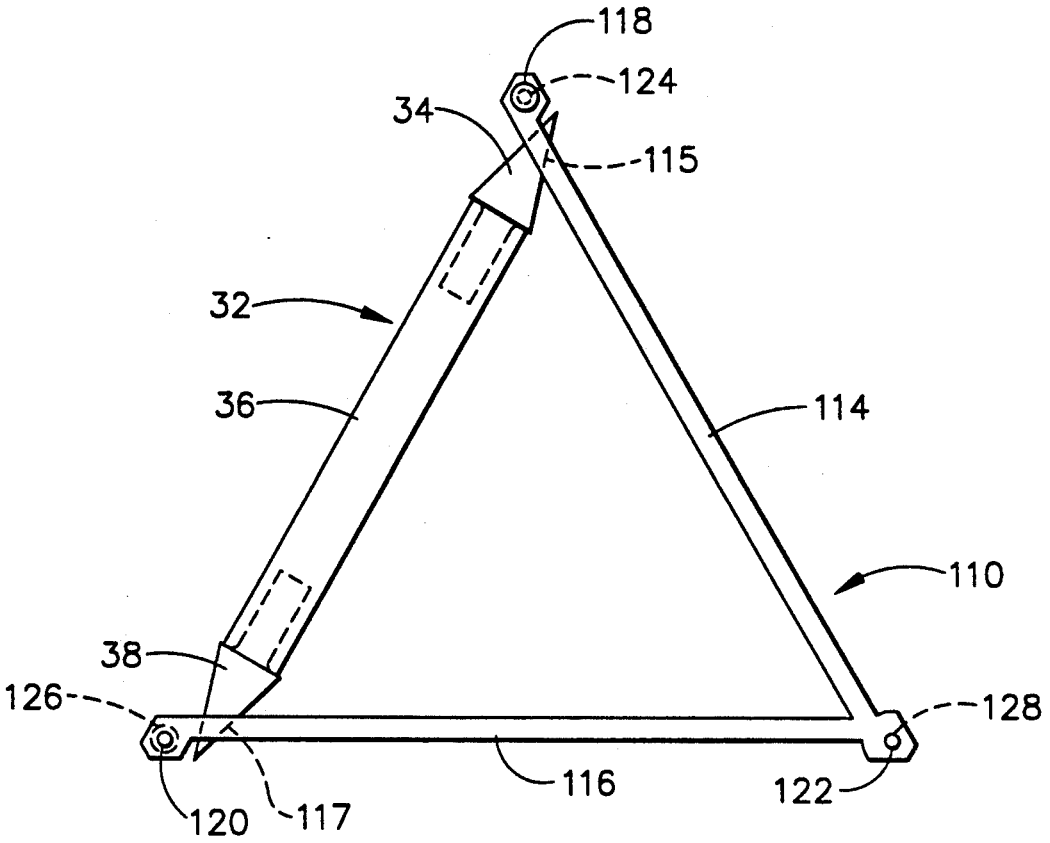
FIG. 9 is a side elevational view of a spike clip holding a three-piece spike subassembly.

As shown in FIGS. 2 and 9, the three-piece spike subassemblies 32 include a first spike tip 34, a spike quill 36, and a second spike tip 38 (which is identical to the first spike tip 34). Spike subassembly 32 is designed to, first, penetrate the surface of a tire by use of the spike tip 34, after which time the spike quill 36 will become embedded in the tread, casing and belts of the tire. As the tire passes over spike subassembly 32, the bottom tip 38 will fall free from the tire because it can easily slide out from the spike quill 36. Once the remaining portions of spike subassembly 32 are rotated to the top of the tire (by the inherent rotation of the tire as it passes over the tire-puncturing apparatus 10), the upper spike tip 34 will similarly fall free from the spike quill 36, thereby falling into the interior spaces of the tire. Since spike quill 36 is hollow, now that it is embedded in the tread, casing and belts of the tire, it will allow the air inside the tire to leak outside due to the pressurization of the interior air. The depressurization of the tire is controlled to the extent that the tire will not blow out, thereby allowing the driver of the vehicle to fairly easily control the direction of the vehicle while the tire is losing air. The spike tips 34 and 38 and spike quill 36 are preferably made of steel.

To seal the ends of tire-puncturing apparatus 10, an end covering 41 formed of tape is placed over the open triangular ends (see FIG. 1). Electric tape can be used to make up and covering 41. Such end covering will make tire-puncturing apparatus 10 weather resistant.

Figure 8:
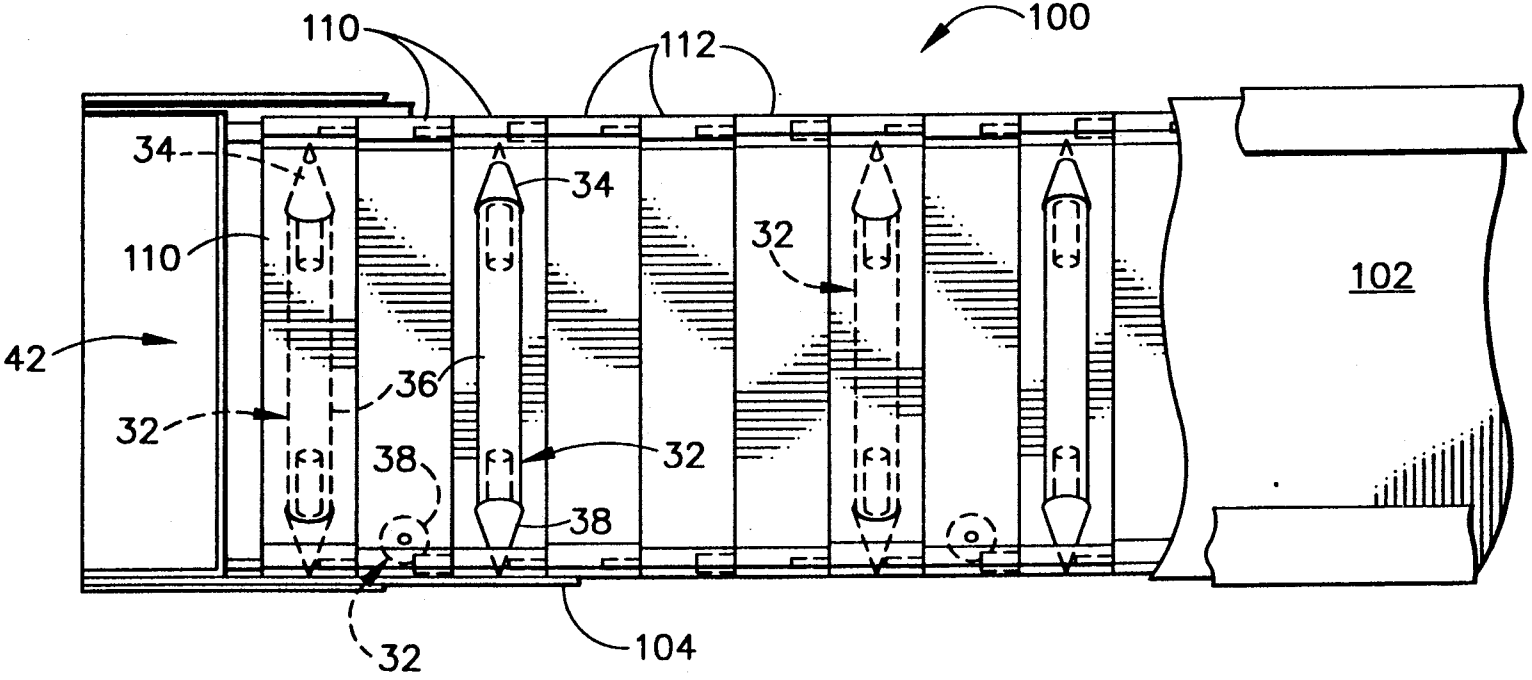
FIG. 8 is a fragmentary partially cut-away elevational view of a second embodiment of a tire-puncturing apparatus.

A second embodiment of the tire-puncturing apparatus is depicted in FIG. 8 in which the apparatus is generally designated by the numeral 100. The second embodiment 100 has similarities to the first embodiment 10, such as having collapsible panels 102, 104 and 106 which are made of laminated paper board. The same three-piece spike subassemblies 32 are used in both of these embodiments, as well.

The inner portion of second embodiment 100 is quite different from the first embodiment 10, in that the three-piece spike subassemblies 32 are held in place by a spike clip 110. Spike clip 110 is best viewed in FIG. 9, which depicts the two arms 114 and 116 of spike clip 110. Spike tip 34 is retained in a mounting hole 115 in the arm 114 of spike clip 110, and spike tip 38 is retained in a similar mounting hole 117 in the arm 116 of the spike clip 110. Each spike clip is preferably one-half inch wide, which maintains the desired spacing of one-half inch between each of the three-piece spike subassemblies 32. The preferred material for spike clip 110 is polyethylene, and must have sufficient mechanical strength to hold the spike subassembly 32 in place during the initial impact of a tire against the spike clip 110, and in addition must be sufficiently flexible so as to easily collapse when such a tire impacts against spike clip 110. Spike clip 110 must be strong enough to hold the lower spike tip 38 in place so that it does not slide out from the tire-puncturing apparatus 100 until the upper spike tip 34 penetrates the tire and allows the spike quill 36 to become embedded in the tread of such tire.

At the end of arms 114 and 116 are mating surfaces which allow the spike clips to be nested together into one interior core subassembly. In particular, mating surface 118 is located at the open end of arm 114, mating surface 120 is at the open end of arm 116, and mating surface 122 is at the junction of the two arms 114 and 116. These mating surfaces are visible on FIG. 9. In addition, mating surfaces are located on the opposite side of spike clip 110, which are designated 124 at the open end of arm 114, 126 at the open end of arm 116, and 128 at the intersection of arms 114 and 116. These mating surfaces will be keyed such that each adjacent spike clip 110 must be assembled at a 60° angle as compared to any of its other adjacent spike clips 110. In other words, mating surface 118 will connect to the opposite mating surface 126 of an adjacent spike clip 110; mating surface 120 will connect to an opposite mating surface 128 in that adjacent spike clip 110; and mating surface 122 will connect to an opposite mating surface 124 also in that adjacent spike clip 110. The keying aspect is effected by use of a pin 118 which is larger in diameter than pins 120 and 122, and will fit only into a relatively large mating socket 126 (and not into smaller sockets 124 or 128).

Figure 10:
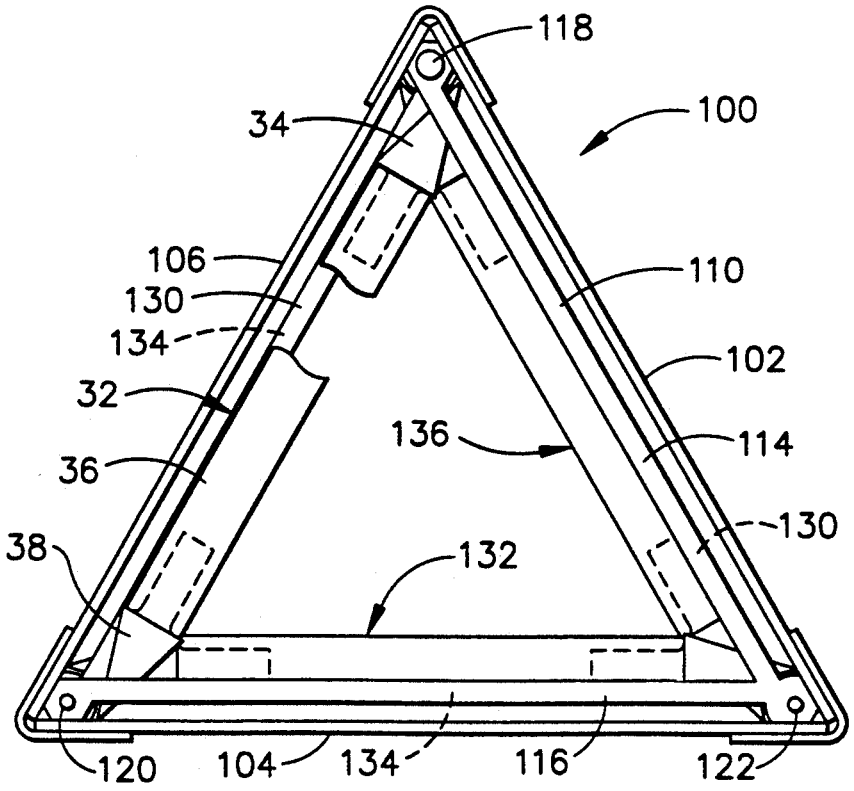
FIG. 10 is a side elevational view of the second embodiment of the tire-puncturing apparatus of FIG. 8, with the end cap removed.

The final result of the assemblage of sets of spike clips 110 is depicted in FIG. 10, in which the nearest spike clip 110, having arms 114 and 116, holds the three-piece spike subassembly 32 in place parallel to panel 106. A second spike clip 110 is adjacent to the first spike clip 110, and the arms of the second spike clip 110 are depicted by the numeral 130 in FIG. 10. A second three-piece spike subassembly 132 is held in place parallel to panel 104 by the second spike clip, in which it can be seen that the arms of the second spike clip 130 help to retain the second three-piece spike subassembly 132 in its proper location. The next adjacent spike clip 110, having its arms depicted in FIG. 10 by the number 134, retains in its proper position a third three-piece spike subassembly 136 parallel to panel 102.

As seen in FIG. 8, three spike clips 110 are grouped together to hold a group of three spike subassemblies 32, in a similar fashion to the first embodiment of the tire-puncturing apparatus 10. Since each spike clip 110 is preferably one-half inch wide, each group of three spike subassemblies 32 becomes a larger subassembly that is approximately 1½" wide. Blank clips 112 are preferably attached adjacent to each group of three spike subassemblies 32, wherein blank clips 112 are identical to spike clips 110 except that they do not contain any actual spike subassemblies 32. The entire interior portion of second embodiment of tire-puncturing apparatus 100 can be assembled by attaching spike clips 110 and blank clips 112 together in the proper order. thereby achieving an interior spike-supporting subassembly. Since there are no adhesives involved in constructing this second embodiment's interior subassembly, the shelf life of the second embodiment 100 is indefinite, as opposed to a limited shelf life of the first embodiment 10 due to its use of strapping tape.

The overall performance of the second embodiment tire-puncturing apparatus 100 is similar to that of the first embodiment 10, in that the three-piece spikes 32 operate in the same manner as before when a tire passes over the tire-puncturing apparatus. As before, the lower spike tip 38 is retained within the tire-puncturing apparatus 100 during the initial impact of the tire against apparatus 100. Once the upper spike tip 34 has penetrated the tire, the quill 36 becomes embedded in that tire. After both spike tips 34 and 38 have fallen away from spike quill 36, due to the rotation of the tire, then the air pressure within the tire is allowed to escape through spike quill 36 to atmosphere, thereby deflating the tire without causing a blow-out.

Figure 4:
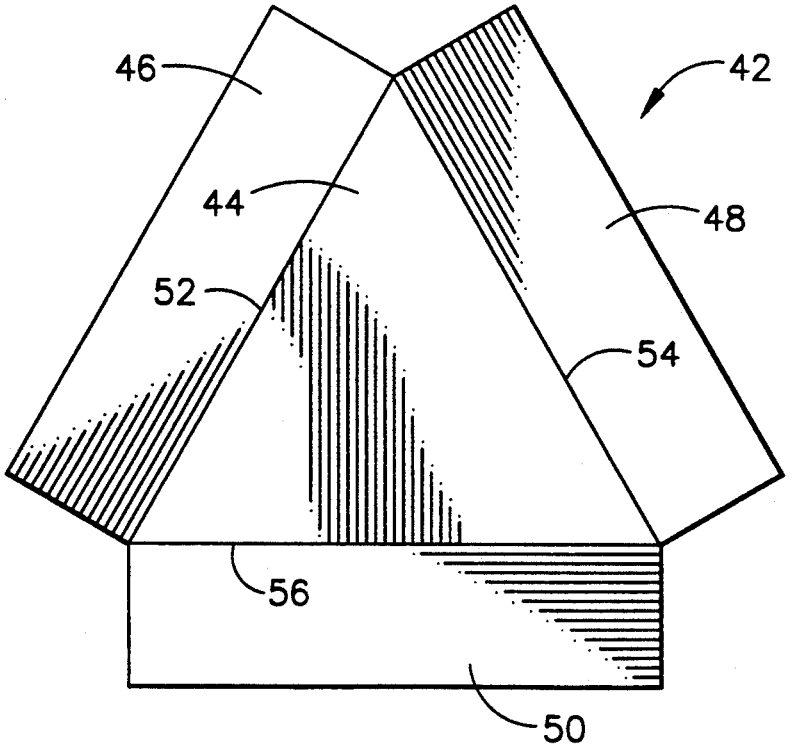
FIG. 4 is a plan view of an unfolded internal end cap.
Figure 5:
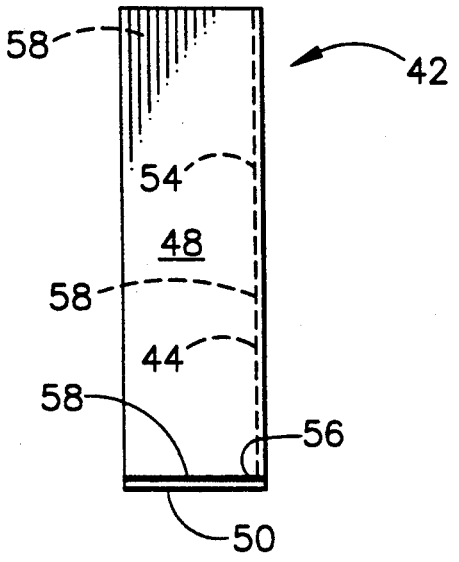
FIG. 5 is a side elevational view of the internal end cap of FIG. 4 after having been folded, taken from the right side of the end cap as viewed in FIG. 4.

To seal the ends of tire-puncturing apparatus 100, an end cap 42 is placed into each of the ends, and held in place by adhesive tape 43 along the edges of the panels 102, 104, and 106. End cap 42 is depicted in detail in FIGS. 4 and 5. As can be seen in FIG. 4, end cap 42 has an overall triangular shape with three extending side flaps 46, 48, and 50. These side flaps border a triangular planar wall 44, in which the side flaps can be folded away from the plane of the planar wall 44 along fold lines 52, 54, and 56. Side flaps 46, 48, and 50, are folded approximately 90° from the planar wall 44, as depicted in FIG. 5.

The entire end cap 42, after the side flaps have been folded, is inserted into each end of tire-puncturing apparatus 100 with the side flaps extending outwardly, as depicted in FIG. 8. The outer surfaces of end cap 42, as viewed once end cap 42 has been assembled to tire puncturing apparatus 100, are laminated so as to protect end cap 42 from the weather. These laminated surfaces are generally depicted by the numeral 58 (See FIG. 5). The materials used for end cap 42 are paper board having a one and one-half (1½) mil polypropylene film lamination covering its outer surfaces (at the locations designated by the numeral 58).

Figure 6:
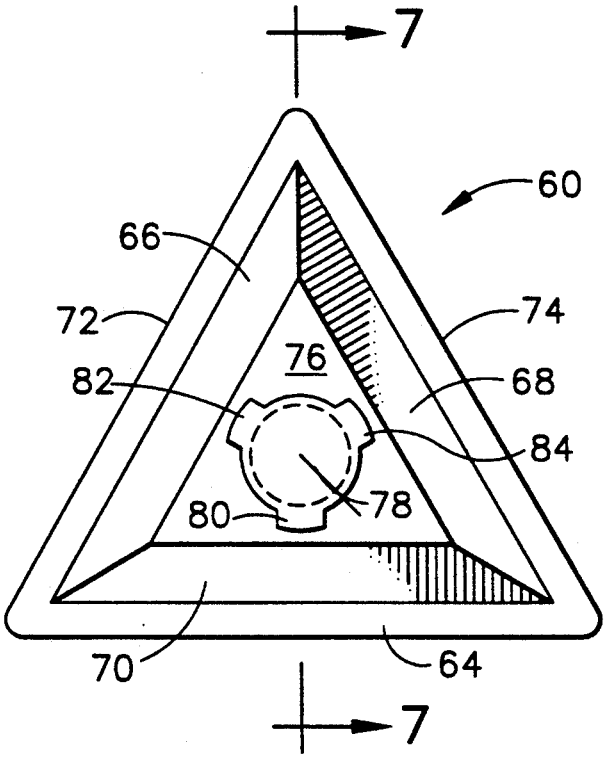
FIG. 6 is a front elevational view of an optional end piece having a male post.

An optional end piece 60 can be additionally installed at the ends of the tirepuncturing apparatus 100 to allow more than one of the devices to be rigidly connected to a second or third device on either or both ends. Once two end caps 42 have been attached to both ends of tire-puncturing apparatus 100, a cavity, which is approximately ¾" deep, is available at each of the ends for adding the optional end piece of assembly 60. As viewed in FIGS. 6 and 7, optional end piece 60 can be provided with a male post 78. A mating female receptacle (not shown) could be assembled to the end cap 42 on the opposite end of tire-puncturing apparatus 100. By mating the male post 60 with a female receptacle (not shown), two of the devices can be rigidly connected together, making a six-foot assembly. In addition, a third device could be assembled to one of the ends of the six-foot assembly, thereby creating an overall nine-foot assembly, which would cover the major portion of a lane of road surface. By using these male-female connectors, such assemblies could be made as long as desired at three-foot increments when using the illustrated embodiment.

Figure 7:
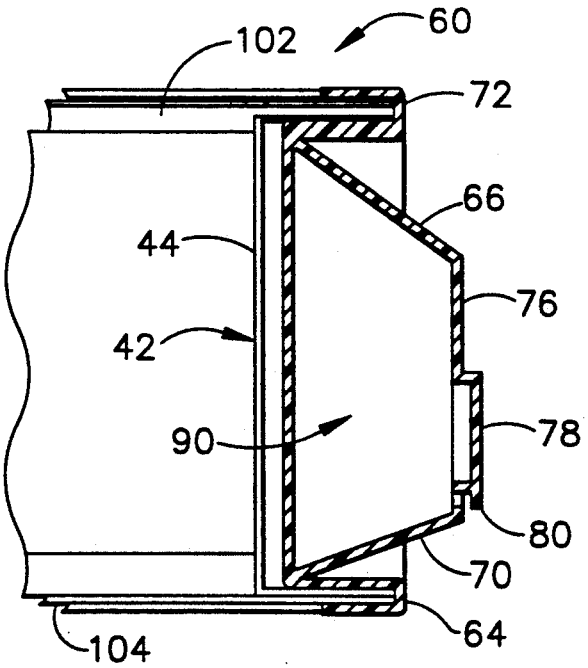
FIG. 7 is a section view of the optional end piece of FIG. 6, taken along the section line 7—7 thereof.

As can best be seen in FIG. 7, optional end piece 60 is assembled over the panels 102, 104, and 106, and into the end cavity space which is available inside the inner spaces of end cap 42. The optional end piece 60 is provided with U-shaped retaining edges 64, 72, and 74, adapted to engage the ends of panels 104, 102, and 106, respectively. U-shaped retainer 62 extends into the interior of end cap 42, at which point it is fixed to a sloped extension 66, which in turn is fixed to a vertical boss 76. Since the overall shape of optional end piece 60 is triangular, there are two other sloped extensions 68 and 70, of which sloped extension 70 is connected to U-shaped retainer 64 and to vertical boss 76. Sloped extension 68 is similarly connected to U-shaped retainer 62 and vertical boss 76. As can be best viewed in FIG. 6, a U-shaped retainer 72 would be installed along one of the edges of a collapsible panel, and a second U-shaped retainer 74 would be installed along a second edge of one of the collapsible panels. The male post 78 has three mating lobes, 80, 82, and 84. The mating female receptacle (not shown) is similar to end cap 60 with the exception that it has an opening corresponding in shape and adapted to receive male post 78 and its lobes 80, 82, and 84. The female receptacle would be engaged by these lobes by a twisting action, thereby locking the female receptacle and the male post together.

Optional end piece 60 is preferably made of a molded plastic such as polyethylene. This plastic must be thin enough so as to easily collapse if a tire of a moving vehicle would happen to roll directly over the optional end piece 60, so that the performance of the remaining portion of the tire-puncturing apparatus 100 would not be degraded.

An additional option is available to use the inner empty spaces 90 of optional end piece 60. This inner space 90 could be used to contain a coiled rope, cord, or string (not shown) which could be attached to the end of tire-puncturing apparatus 100. By use of this rope, cord, or string the tire-puncturing apparatus 100 could be deployed on one side of a road surface (such as on its shoulder), with the rope or cord laying across the portion of the road surface which is being used by public traffic. At the time the tire-puncturing apparatus 100 needed to be placed onto the portion of the road surface which is being used by traffic, a person could pull the rope from the opposite side of the lane of traffic, thereby pulling the tire-puncturing apparatus 100 onto the proper location of the road surface. In this way, a police officer could deploy the device without physically being required to jump in front of the fleeing vehicle to position the apparatus at the proper time.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

We claim:

1. A tire deflating apparatus for use with a road surface, comprising:

(a) a plurality of spikes which are oriented so as to penetrate a tire of a vehicle as the vehicle travels over said tire deflating apparatus;

(b) a support structure which maintains said plurality of spikes in said orientation; and (c) an exterior collapsible cover at least partially surrounding said plurality of spikes, said collapsible cover protecting the user while handling said tire deflating apparatus, said collapsible cover having a longitudinal dimension which is much greater than its transverse dimension, and said orientation of said plurality of spikes tending to puncture a tire which rolls over the tire deflating apparatus in said transverse direction, said collapsible cover engaging the road surface.

2. The tire deflating apparatus as recited in claim 1, wherein said collapsible cover is weather resistant.

3. The tire deflating apparatus as recited in claim 2, wherein said collapsible cover comprises paper board having an outer lamination comprising plastic.

4. The tire deflating apparatus as recited in claim 2, wherein said collapsible cover comprises an extruded polymer material.

5. The tire deflating apparatus as recited in claim 2, wherein said collapsible cover comprises extruded Butyrate plastic.

6. The tire deflating apparatus as recited in claim 1, wherein said plurality of spikes comprise spike assemblies, each including:

(a) a tubular member having a first open end and a second open end, said first open end having an inner diameter and said second open end having an inner diameter; and (b) a first and a second tip, each tip having a conically-shaped portion, said conically-shaped portion including a base and terminating in a pointed first end distally located from said base, said first and second tips additionally having a cylindrically-shaped longitudinal portion protruding from said base of said conically-shaped portion, said cylindrically-shaped longitudinal portion terminating at a second end, said base of the conically-shaped portion having a greater diameter than the diameter of said cylindrically-shaped longitudinal portion, said cylindrically-shaped longitudinal portion's diameter being significantly less than the inner diameter of said tubular member such that the second end of said first and second tips fits loosely into the first and second open ends, respectively, of said tubular member while said tubular member's longitudinal axis is substantially aligned with said first and second tip's longitudinal axis.

7. A tire deflating apparatus, comprising:

(a) a plurality of spikes which are oriented so as to penetrate a tire of a vehicle as the vehicle travels over said tire deflating apparatus;

(b) means for holding said plurality of spikes in the said orientation; and (c) means for protecting the user while handling said tire deflating apparatus, comprising an exterior collapsible cover at least partially surrounding said plurality of spikes, said collapsible cover having a longitudinal dimension which is much greater than its transverse dimension, and said orientation of said plurality of spikes tending to puncture a tire which rolls over the tire deflating apparatus in said transverse direction, apparatus comprising an elongated element having a substantially triangular cross-section.

8. The tire deflating apparatus as recited in claim 5, wherein said collapsible cover comprises three rectangular panels each having longitudinal edges, each panel of which join together at their adjacent longitudinal edges, each of said plurality of spikes being oriented parallel to one of the panels of said collapsible cover.

9. The tire deflating apparatus as recited in claim 8, wherein, as said tire deflating apparatus rests upon a surface, the first of said plurality of spikes has its longitudinal axis in the horizontal plane, the second of said plurality of spikes has its longitudinal axis at an angle 60° from the horizontal plane, and the third of said plurality of spikes has its longitudinal axis at an angle 120° from the horizontal plane.

10. A tire deflating apparatus comprising:

(a) a plurality of spikes which are oriented so as to penetrate a tire of a vehicle as the vehicle travels over said tire deflating apparatus;

(b) means for holding said plurality of spikes in the said orientation;

(c) means for protecting the user while handling said tire deflating apparatus, comprising an exterior collapsible cover at least partially surrounding said plurality of spikes, said collapsible cover having a longitudinal dimension which is much greater than its transverse dimension, and said orientation of said plurality of spikes tending to puncture a tire which rolls over the tire deflating apparatus in said transverse direction; and (d) a collapsible end cap operationally attached to each of the two distal ends of said collapsible cover.

11. Two or more tire deflating apparatus as recited in claim 10, wherein two or more tire deflating apparatus are arranged end to end with adjacent end caps releasably connected to each other.

12. The tire deflating apparatus as recited in claim 11, wherein at least one of the endmost end caps contains a cord which is used to pull said tire deflating apparatus across a road surface.

13. A spike assembly comprising:

(a) a tubular member having a first open end and a second open end, said first open end having an inner diameter and said second open end having an inner diameter;

(b) a first tip having a conically-shaped portion, said conically-shaped portion including a base and terminating in a pointed first end distally located from said base, said first tip additionally having a cylindrically-shaped longitudinal portion protruding from said base of said conically-shaped portion, said cylindrically-shaped longitudinal portion terminating at a second end, said base of the conically-shaped portion having a greater diameter than the diameter of said cylindrically-shaped longitudinal portion, said cylindrically-shaped longitudinal portion's diameter being significantly less than the inner diameter of said tubular member such that the second end of said first tip fits loosely into the first open end of said tubular member while said tubular member's longitudinal axis is substantially aligned with said first tip's longitudinal axis; and (c) a second tip having a conically-shaped portion, said conically-shaped portion including a base and terminating in a pointed first end distally located from said base, said second tip additionally having a cylindrically-shaped longitudinal portion protruding from said base of said conically-shaped portion, said cylindrically-shaped longitudinal portion terminating at a second end, said base of the conically-shaped portion having a greater diameter than the diameter of said cylindrically-shaped longitudinal portion, said cylindrically-shaped longitudinal portion's diameter being significantly less than the inner diameter of said tubular member such that the second end of said second tip fits loosely into the second open end of said tubular member while said tubular member's longitudinal axis is substantially aligned with said second tip's longitudinal axis.

14. The spike assembly as recited in claim 13, wherein said first and second tips are configured to easily penetrate the tread of the tire of a moving vehicle as that vehicle passes over the spike assembly.

15. The spike assembly as recited in claim 13, wherein said first and second tips are made of steel.

* * * * *

UNITED STATES PATENT AND TRADEMARK OFFICE

CERTIFICATE OF CORRECTION

PATENT NO. : 5,330,285

DATED : July 19, 1994

INVENTOR(S) : Kenneth J. Greves & Daniel R. Olive

It is certified that error appears in the above-indentified patent and that said Letters Patent is hereby corrected as shown below:

Column 10, line 23, (claim 7), after the word "direction," please insert --said tire deflating--.

Column 10, line 26, (claim 8), delete "5" and insert therefor --7--.

Signed and Sealed this

Eleventh Day of October, 1994

*Attest:*

*Attesting Officer*

Bruce Lehman

BRUCE LEHMAN

*Commissioner of Patents and Trademarks*